US011026489B2

(12) United States Patent
Wood

(10) Patent No.: US 11,026,489 B2
(45) Date of Patent: Jun. 8, 2021

(54) ANTI-THEFT DEVICE

(71) Applicant: Abigail E. Wood, Wauwatosa, WI (US)

(72) Inventor: Abigail E. Wood, Wauwatosa, WI (US)

( * ) Notice: Subject to any disclaimer, the term of this patent is extended or adjusted under 35 U.S.C. 154(b) by 296 days.

(21) Appl. No.: 16/161,851

(22) Filed: Oct. 16, 2018

(65) Prior Publication Data

US 2020/0113303 A1 Apr. 16, 2020

(51) Int. Cl.

| | |
|---|---|
| ***A45C 13/18*** | (2006.01) |
| ***A45C 1/06*** | (2006.01) |
| ***A45F 5/02*** | (2006.01) |
| *A44C 19/00* | (2006.01) |

(52) U.S. Cl.

CPC ..... *A45C 13/185* (2013.01); *A45C 1/06* (2013.01); *A45C 13/18* (2013.01); *A45F 5/022* (2013.01); *A44C 19/00* (2013.01)

(58) Field of Classification Search

CPC ..... A45C 13/185; A45C 13/18; A45C 1/06; A45F 5/022; A44C 19/00; A47H 1/022; A47H 1/08; A47H 1/00; A47K 3/38

USPC ..... 150/134, 102, 101, 133; 24/3.5; 211/105.6

See application file for complete search history.

(56) References Cited

U.S. PATENT DOCUMENTS

| | | | | | |
|---|---|---|---|---|---|
| 961,352 | A * | 6/1910 | Walters | A47H 1/022 | 211/105.6 |
| 1,121,465 | A * | 12/1914 | Brown | A45C 13/185 | 24/3.5 |
| 1,610,382 | A * | 12/1926 | Jeffries | A45C 13/185 | 24/3.5 |
| 2,129,018 | A * | 9/1938 | Martini, Jr. | A45C 13/185 | 24/3.5 |
| 2,574,023 | A * | 11/1951 | Du Fault | A45C 13/185 | 24/3.5 |
| 5,031,281 | A * | 7/1991 | Devylder | A45C 13/185 | 24/3.5 |

* cited by examiner

*Primary Examiner* — James N Smalley
*Assistant Examiner* — Jennifer Castriotta
(74) *Attorney, Agent, or Firm* — Davis & Kuelthau, sc; Joseph S. Heino; Erin E. Kaprelian

(57) ABSTRACT

A device comprises a first tube having a first diameter and a second tube having a second diameter. A spring may be disposed between the first tube and the second tube. The spring may couple the first to the second tube. A plurality of tines may be disposed at a first end of the first tube and at a first end of the second tube.

7 Claims, 2 Drawing Sheets

ANTI-THEFT DEVICE

BACKGROUND

Many people regularly carry a wallet to store money, credit cards, identification, and other important documents. One place a wallet is often carried is in a rear pants pocket. Although having one's wallet in one's pocket is convenient, the wallet may be susceptible to theft.

DETAILED DESCRIPTION

Carrying a wallet to store money, credit cards, identification, and similar documents is a common practice. Often, people, particularly men, will carry their wallet in a rear pocket of a pair of pants. This allows the wallet to be easily accessible while remaining unobtrusive when not needed. However, carrying a wallet in a back pocket also presents a risk, namely, the wallet being stolen by a pickpocket or similar. Unfortunately, by the time the theft is discovered, the thief may be long gone with the wallet and its contents. As a result, the owner of the wallet may have to replace cards and identification, which is stressful and takes both time and money.

One way to help mitigate the chance of getting one's wallet taken is to change the pocket in which the wallet is carried to, for example, a front pocket of the pair of pants. By moving the wallet to the front pocket, a potential thief would have to reach around the wallet's owner or be facing the owner in order to steal the wallet. Since much pick-pocket-type theft is based on ease of target (i.e., a pickpocket is more likely to target a person who they think they can steal from without getting caught), a pickpocket is less likely to attempt to, or be successful in, theft of the wallet. However, not all pants pockets are sufficiently deep to allow a wallet, particularly a bulky wallet, to fit comfortably. In addition, not all pants have front pockets to place a wallet into.

Another option is to carry one's wallet in a separate, secondary accessory, such as a purse, a backpack, or a fanny pack. Although such accessories may be useful, particularly in situations such as when traveling, they may not be practical for everyday use. In addition, it may not always be feasible to carry additional accessories, particularly for the sole purpose of carrying a wallet. Moreover, not everyone may be comfortable with carrying an additional accessory, particularly in certain circumstances. For example, wearing a fanny pack while out sightseeing may serve to mark a user as a "typical tourist", which may lead to a pickpocket or other thief marking the user as an easy target.

The anti-theft device of the present disclosure, by contrast, is small and unobtrusive enough that a user is able to deploy the device without giving an indication that such a device is, in fact, being used. A pair of tubes are joined by a spring that is able to be compressed and released. On an outer end of each tube is a plurality of angled tines that are able to engage with the fabric of a pocket when the wallet including the device is inserted. The tubes, including the tines, may be compressed at the spring by a pair of lips to insert the wallet into a pocket; then, upon release of the spring, the tines may engage with the fabric of the pocket.

As a result, the wallet may be prevented from inadvertent removal and, should someone attempt to remove the wallet, the owner of the wallet may be alerted.

Figure 1:
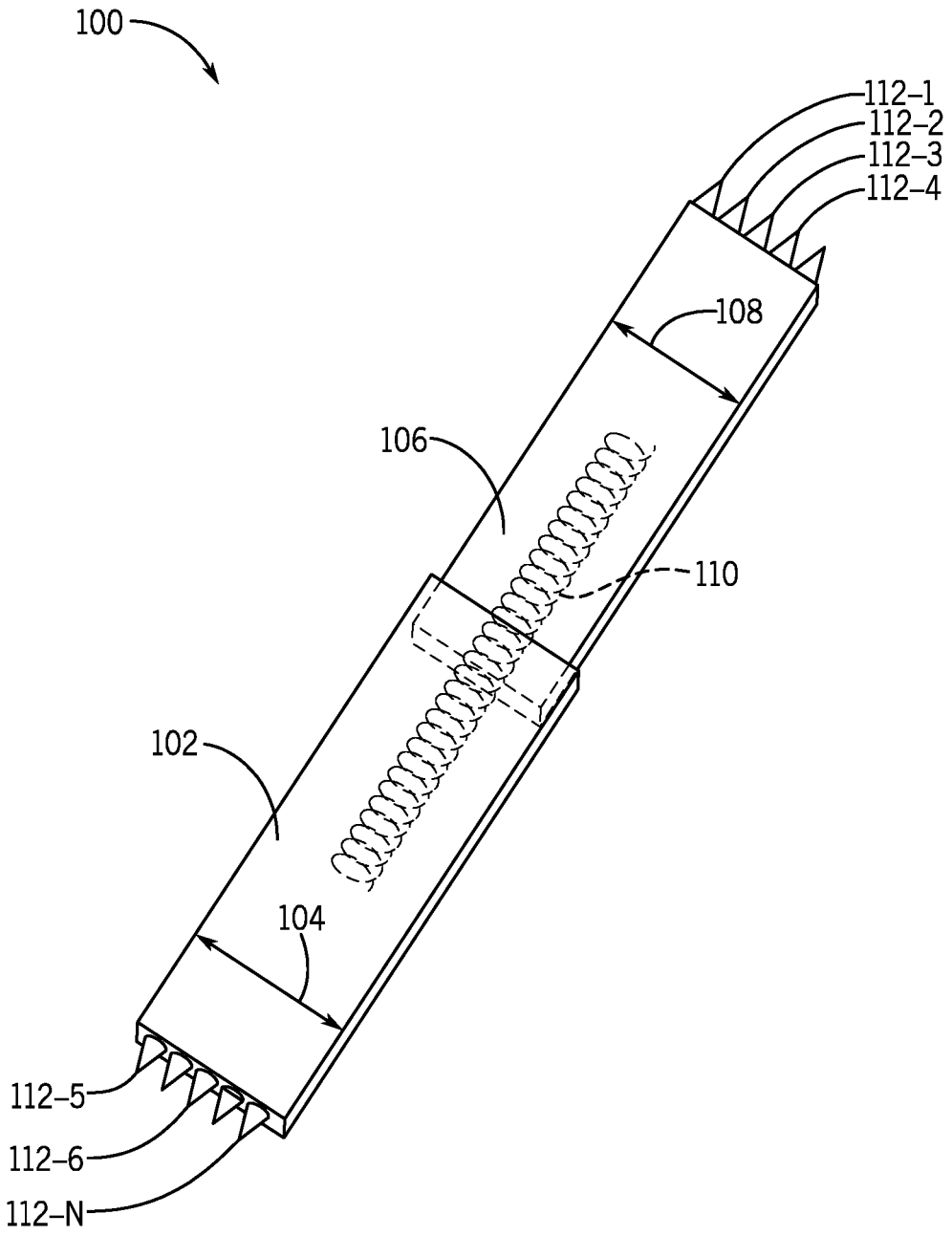
FIG. 1 is an example anti-theft device consistent with the present disclosure.

FIG. 1 is an example anti-theft device 100 consistent with the present disclosure. Device 100 may comprise a first tube 102 having a first diameter 104. Device 100 may further comprise a second tube 106 having a second diameter 108. Although first tube 102 and second tube 106 are shown as rectangular tubes in FIG. 1, examples are not so limited and other shapes of tube may be used. For example, first tube 102 and second tube 106 may be circular, oblong, or geometrical in shape. The first diameter 104 may be greater than the second diameter 108; that is, first tube 102 may have a greater diameter than second tube 106. First tube 102 and second tube 106 may be metal, plastic, or any other rigid material.

A spring 110 may be disposed between the first tube 102 and the second tube 106. Spring 110 may be a metal spring and may be a coil spring, a compression spring, or any other type of spring. A first end of spring 110 may be coupled to first tube 102, while a second end of spring 110 may be coupled to second tube 106. As a result, spring 110 may be disposed between the first tube 102 and the second tube 106 such that the first tube 102 is coupled to the second tube 106 by the spring 110. Said differently, spring 110 may join the first tube 102 and the second tube 106.

Spring 110 may be compressible; that is, spring 110 may be pressed together such that its length decreases. Because first tube 102 and second tube 106 may be coupled together by spring 110, compression of spring 110 also moves first tube 102 and second tube 106 closer together. However, because first tube 102 has a greater diameter (first diameter 104) than the second tube 106 (having second diameter 108), second tube 106 may slidably engage with first tube 102. That is, second tube 106 may slide into the first tube 102 when the spring 110 is compressed. When spring 110 is released, second tube 106 may retract from first tube 102.

Device 100 may further include a plurality of tines 112-, 112-2, 112-3, 112-4, 112-5, 112-6 . . . 112-N (collectively, tines 112). As used herein, a tine refers to a prong or other sharp point that extends outwardly from a surface. Tines 112 may be disposed at a first end of first tube 102 and at a first end of second tube 106. In some examples, tines 112 may be disposed on opposing ends; that is, tines 112 may be on the outwardly-facing ends of device 100. Tines 112 may engage with fabric of a pocket when device 100 is in use.

In some examples, tines 112 may be disposed at an angle with respect to the first tube 102 and the second tube 106. Tines 112 may be disposed at an angle of between 50 degrees and 70 degrees with respect to the surface upon which tines 112 are disposed. For example, tines 112 may be disposed at a 60 degree angle with respect to the first tube 102; however, examples are not so limited and other angles may be used. By being angled, tines 112 may engage with the fabric of a pocket in such a way that removal of device 100 is rendered more difficult because removing the device 100 without compressing the spring 110 moves tines 112 opposite the angle at which they are disposed. Said differently, angling tines 112 may provide an additional layer of security when device 100 is in use; not only are tines 112 engaged with a pocket, tines 112 are engaged with the pocket in such a way as to make unwanted removal of device 100 more difficult, and more apparent to a user.

Device 100 may further include a first lip disposed on an upper surface of first tube 102. The first lip may extend past the first diameter 104 of first tube 102; that is, the first lip may reach past the edge of first tube 102. A second lip may similarly be disposed on an upper surface of second tube 106. Like the first lip, the second lip may extend past the second diameter 108 of the second tube 106. Together, the lips may allow a user to compress spring 110, thus compressing first tube 102 and second tube 106, at an easier-to-grasp location than, for example, tines 112. In addition, the first lip and the second lip may be accessible when device 100 is in use, such that a user is able to remove device 100 should he or she so desire.

Figure 2:
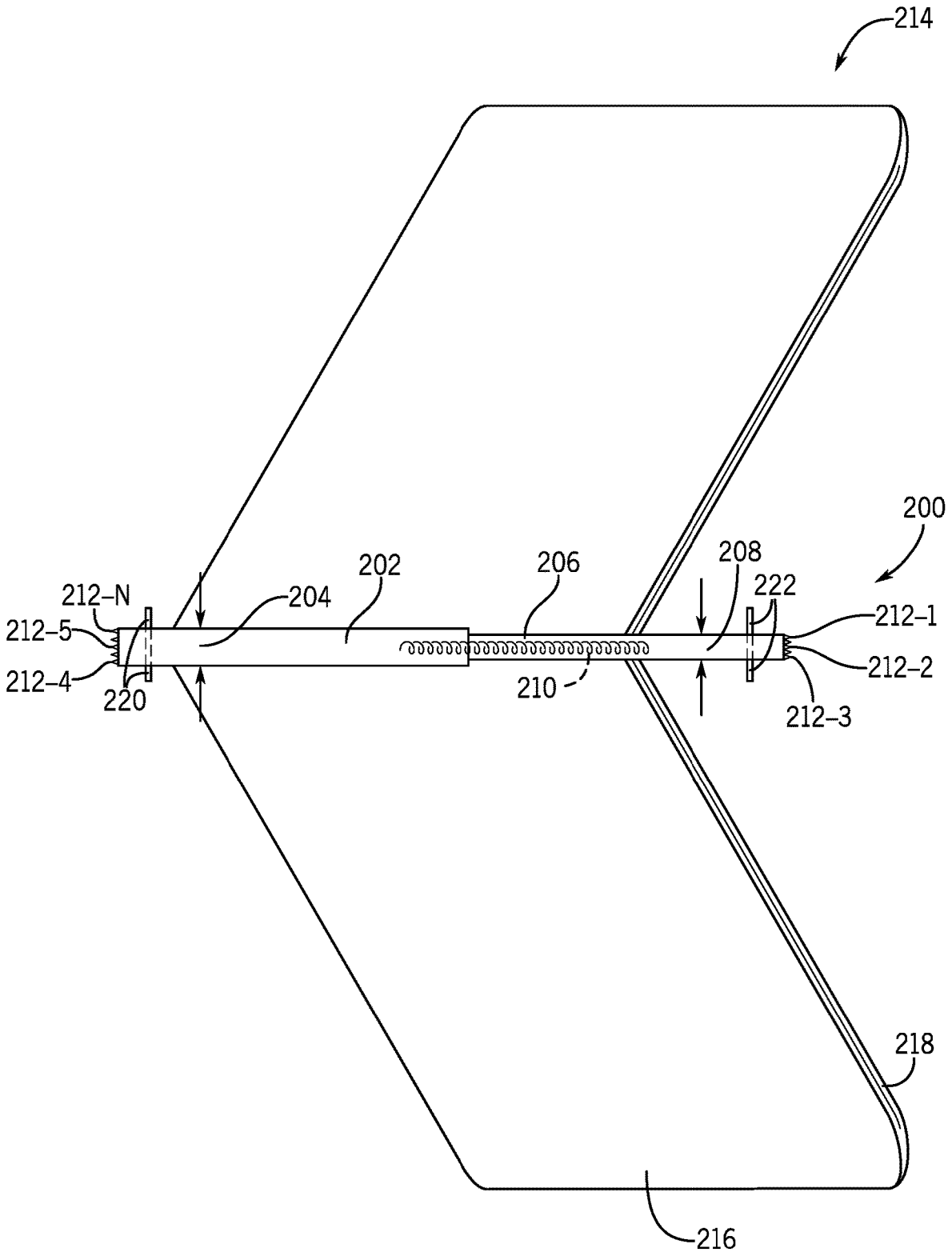
FIG. 2 is an example system including an anti-theft device consistent with the present disclosure.

FIG. 2 is an example system 214 including an anti-theft device 200 consistent with the present disclosure. System 214 may include a wallet 216. Although a bi-fold wallet is shown in FIG. 2, examples are not so limited and other types of wallet (e.g., a tri-fold wallet) may be used. Wallet 216 may include an opening 218 disposed along a length thereof. Opening 218 may be used to receive, for example, cash or other documents.

System 214 may further include a device 200 to engage with wallet 216. Device 200 may be akin to device 100, discussed with respect to FIG. 1. In some examples, device 200 may engage with wallet 216 along a fold thereof. More particularly, device 200 may engage with 216 such that opening 218 of wallet 216 faces upwards with respect to the ground when the device 200 is in use.

Device 200 may include a first tube 202 having a first diameter 204 and a second tube 206 having a second diameter 208. Second diameter 208 may be less than first diameter 204 such that second tube 206 is able to slidably engage with first tube 202. A spring 210 may be disposed between first tube 202 and second tube 206 such that first tube 202 and second tube 206 are coupled to one another by spring 210.

A first lip 220 may be disposed on an upper surface of first tube 202. As shown in FIG. 2, first lip 220 may be disposed such that it is substantially parallel to the diameter of first tube 202 and is substantially perpendicular to a length of first tube 202. First lip 220 may extend past the edges of first tube 202. A second lip 222 may be similarly disposed on an upper surface of second tube 206. Like first lip 220, second lip 222 may be substantially parallel to the diameter of second tube 206 and may extend past the edges of second tube 206.

First lip 220 and second lip 222 may receive an applied force from a user. When first lip 220 and second lip 222 receive an applied force, spring 210 may be engaged and may compress. Engagement of spring 210 may cause second tube 206 to slide into first tube 202 such that the overall length of device 200 is shortened. By contrast, when first lip 220 and second lip 222 are in a resting position, i.e. not having a force applied, spring 210 may be disengaged, or not compressed.

Device 200 may further include a plurality of tines 212-1, 212-2, 212-3, 212-4, 212-5 . . . 212-N (collectively, tines 212) disposed on a first end of first tube 202 and on a first end of second tube 206. As discussed with respect to FIG. 1, tines 212 may be disposed such that they are on opposing ends of device 200. Tines 212 may further be disposed at an angle with respect to first tube 202 and second tube 206.

When device 200 is engaged with wallet 216, device 200 may be placed along a fold of wallet 216. Tines 212 may extend past the edge of wallet 216, as shown in FIG. 2. In addition, a portion of first tube 202 and a portion of second tube 206, including first lip 220 and second lip 222, may also extend past the edges of wallet 216 when the device 200 is placed into wallet 216. To engage the device 200, spring 210 may be compressed by applying a force to first lip 220 and second lip 222 simultaneously. As previously discussed, doing so may cause second tube 206 to slide into first tube 202, shortening the length of device 200. The wallet 216 may then be inserted into a pocket without interference from, for instance, tines 212.

Upon insertion into a pocket, the spring 210 may be disengaged by releasing the applied force on first lip 220 and second lip 222. By releasing the spring 210, first tube 202 and second tube 206 may cease being slidably engaged with one another. In addition, tines 212 may engage with the fabric of the pocket. Because tines 212 are disposed at an angle with respect to the ends of the first tube 202 and the second tube 206, tines 212 may catch the fabric of the pocket, particularly at a seam of the pocket. Tines 212 thus retain wallet 216 in its position with respect to the pocket and make it more difficult for the wallet 216 to be removed by someone other than a user. However, the user is able to remove the wallet 216 by reapplying a force to first lip 220 and second lip 222, compressing the spring 210. This draws the tines 212 away from the pocket such that wallet 216 is able to be removed as necessary by the user.

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and relative scale of the elements provided in the figures are intended to illustrate the examples of the present disclosure and should not be taken in a limiting sense.

The invention claimed is:

1. A system, comprising:

a wallet including an opening disposed along a length of the wallet; and a device to engage with the wallet along a fold of the wallet, the device further comprising:

a first tube having a first diameter;

a second tube having a second diameter, wherein the second diameter is less than the first diameter;

a spring disposed between the first tube and the second tube such that the first tube is coupled to the second tube by the spring;

a first lip disposed on an upper surface of the first tube;

a second lip disposed on an upper surface of the second tube; and a plurality of tines disposed at a first end of the first tube and at a first end of the second tube.

2. The system of claim 1, wherein the device engages with the wallet along the fold of the wallet.

3. The system of claim 2, wherein the device is engaged with the wallet such that the opening of the wallet faces upward.

4. The system of claim 1, wherein:

the spring is engaged when the first lip and the second lip receive an applied force; and the second tube slides into the first tube when the spring is engaged.

5. The system of claim 1, wherein the spring is disengaged when the first lip and the second lip are in a resting position.

6. The system of claim 1, wherein:

the wallet is inserted into a pocket when the device is engaged with the wallet; and the plurality of tines engages with the pocket upon insertion.

7. The system of claim 1, wherein the plurality of tines is disposed at an angle with respect to the device.

* * * * *